US008061086B2

(12) United States Patent
Haun

(10) Patent No.: US 8,061,086 B2
(45) Date of Patent: Nov. 22, 2011

(54) THRESHOLD WITH REMOVABLE FLASHING

(75) Inventor: Steven William Haun, Landisville, PA (US)

(73) Assignee: Tell Manufacturing, Inc., Lititz, PA (US)

( * ) Notice: Subject to any disclaimer, the term of this patent is extended or adjusted under 35 U.S.C. 154(b) by 522 days.

(21) Appl. No.: 11/625,509

(22) Filed: Jan. 22, 2007

(65) Prior Publication Data

US 2008/0172950 A1 Jul. 24, 2008

(51) Int. Cl.
*E06B 1/22* (2006.01)
*E06B 1/70* (2006.01)

(52) U.S. Cl. ..... 52/60; 52/211; 49/467

(58) Field of Classification Search ..... None
See application file for complete search history.

(56) References Cited

U.S. PATENT DOCUMENTS

| | | | | | |
|---|---|---|---|---|---|
| 1,890,672 | A * | 12/1932 | Coco | 49/467 |
| 2,788,551 | A * | 4/1957 | Hildreth | 49/467 |
| 3,079,652 | A * | 3/1963 | Wahlfeld | 49/469 |
| 3,774,343 | A * | 11/1973 | Cribben et al. | 49/467 |
| 3,990,187 | A * | 11/1976 | Brown et al. | 49/467 |
| 4,055,917 | A * | 11/1977 | Coller | 49/469 |
| 5,469,665 | A * | 11/1995 | Biebuyck | 49/470 |
| 5,673,517 | A * | 10/1997 | Stanclift | 49/468 |
| 7,266,929 | B1 * | 9/2007 | Allred et al. | 52/211 |
| 2004/0200152 | A1 * | 10/2004 | Khanlarian | 49/468 |

OTHER PUBLICATIONS

Elixir Industries product description for the "200 Series Manufactured Home Door", Jan. 16, 2007, 2 pages. (http://www.elixir76.com/?division=elixir76&page=products&productid=102).

Elixir Industries product description for the "400 Series Vinyl Steel Manufactured Home Door", Jan. 16, 2007, 2 pages. (http://www.elixir76.com/?division=elixir76&page=products&productid=103).

Philips Products product description for the"Series 6000 Steel Entry Door", Jan. 16, 2007, 3 pages. (http://www.philipsproducts.com/ExterirorDoors/ResidentialDoors/6000SteelSeries/tabid/127/Default.aspx).

Philips Products product description for the "Series 5100/5140 Outswing Door", Jan. 1, 2007, 4 pages. (http://www.philipsproducts.com/ExteriorDoors/OutswingDoors/51005140Series/tabid/130/Default.aspx).

Pocahontas Aluminum Company, Inc. product line information, Jan. 16, 2007, 14 pages. (http://www.pocahontasaluminum.com/doors.html).

* cited by examiner

*Primary Examiner* — Dalena Tran
*Assistant Examiner* — Jason Holloway
(74) *Attorney, Agent, or Firm* — Thomas E. Loop; Graybeal Jackson LLP

(57) ABSTRACT

A threshold system, having a threshold and a flashing removably connected to the threshold is disclosed. The threshold system including a threshold and a flashing removably connected to the threshold. The threshold having a front incline, a front support, an arm, with the front support and the arm forming a portion of the front incline and extending toward a threshold front. the arm includes an underside and a hook, whereby the hook bends back toward a threshold rear. A frontal pocket is defined by a space within a flashing receiving space between a hook upper side and underside of the arm.

2 Claims, 7 Drawing Sheets

THRESHOLD WITH REMOVABLE FLASHING

FIELD OF THE INVENTION

The present invention relates generally to thresholds and particularly to a threshold system having an optional associated flashing.

BACKGROUND

Currently, doors are typically framed with a jamb that surrounds the door. The jamb acts as a stop to fix the door in the closed position and seals the door opening against air penetration and weather. Most exterior doorways and some interior doorways have a threshold plate installed on the floor. The threshold plate is usually constructed of a rigid, nonporous wear and corrosion resistant material. When used with a sealing device typically extending beyond the bottom of a door, the threshold also serves to block air infiltration and weather at the interface between the door and the threshold. The threshold can also act to seal the door opening against fire. Conventionally, the threshold is attached to the floor or other support surface below the threshold with adhesives and/or screws. The threshold is sometimes sealed to the floor or support surface using a caulk.

Some buildings are constructed as modular building units. These buildings are normally constructed at a factory on a chassis with wheels. When the building is completed, it is then towed to its final location. Manufacturing efficiency methods are employed to speed the assembly of these modular buildings. One such manufacturing efficiency method includes the installation of modular doors to reduce the installation time attributable to installing a door to the doorway of a modular building.

A modular door is typically supplied as a complete door, jamb, and threshold assembly. Modular doors produced by Elixir Industries (24800 Chrisanta Drive, Suite 210, Mission Viejo, Calif. 92691) can be viewed on the Internet. Similarly, modular doors produced by Pocahontas Aluminium Company Inc. (physical address unknown) can be also viewed on the Internet. Further, modular doors are produced or distributed by Active Door & Window Co. (644 Union Ave., Holtsville, N.Y. 11742). Finally, modular doors produced by Philips Products (3221 Magnum Drive, Elkhart, Ind. 46516) may be viewed on the Internet.

To install the modular door assembly, the modular door assembly is placed into a prepared opening in a wall of the building and fastened to the wall by screws and/or other means. A problem with current modular door assemblies is that when the modular door is mounted in the door opening, a flat threshold allows water, air, and insect infiltration to the floor or support beneath the threshold if all the openings are not caulked or if applied caulk cracks or deteriorates. In particular, where a threshold is secured to the floor or support surface by inserting fasteners through holes in a top surface of the threshold, the hole generally presents a passageway for water, dirt, and other particulate matter to contact the floor or support surface, thereby causing rot and/or other deterioration. Over time, and especially if water has been allowed to contact the support beneath the threshold, the wall opening below the threshold often deteriorates significantly. In a case where this wear and/or rot has taken place, the overall doorway stability is compromised as well as rendering subsequent replacement of a door troublesome since the deteriorated door opening will be harder to seal and is cosmetically unappealing. Ultimately, deterioration of the door opening must sometimes be solved by rework of the building structure itself, which can be a time consuming and costly endeavor. To prevent infiltration of water, insects, and air, the application of caulk or the use of a door with four side flanges is often employed. In order to improve the appearance of doors, custom cut molding may be applied to cover unsightly edges of the doorway. However, these installation methods are costly and time consuming.

Modular doors are typically constructed with a threshold mounting flange. This mounting flange forms part of the door jamb. It is generally formed as a flat surface parallel to the face of the door that will allow the modular door assembly to be screwed directly to the face of a wall. As mentioned above, some modular door assemblies also have a mounting flange around all four sides of the door. The threshold mounting flange extends beneath the threshold approximately perpendicular to the underside of the threshold and is generally in plane with the top and side mounting flanges. In such cases, the mounting flange forms an integral and irremovable part of the threshold. Modular door assemblies with four side mounting flanges give additional support to the threshold and improve sealing between the threshold and the wall, but these assemblies are easily damaged and difficult to handle prior to installation. In storage, the modular door assemblies are often situated to rest on one of the mounting flanges, which causes damage (sometimes irreparable) to the mounting flange and renders the entire assembly useless or significantly reduces ease of installation and/or effectiveness during its service life. In addition, during the installation process, the modular door assembly is often transported by sliding the assembly along a floor in a manner that the thin edges of the mounting flanges dig into the floor, causing damage to the door assembly, the floor, and increasing the difficulty of maneuver the door assembly. These problems are worsened when the four side-mounting flanges are constructed of weak or lightweight materials that are more easily damaged by improper handling and lead to a shortened service life.

BRIEF SUMMARY

A threshold system, having a threshold and a flashing removably connected to the threshold is disclosed.

BRIEF DESCRIPTION OF THE DRAWINGS

Further details, advantages and features of the present invention will become apparent from the following description of an exemplary embodiment together with the drawings, in which.

DETAILED DESCRIPTION OF THE EMBODIMENT(S)

Figure 1:
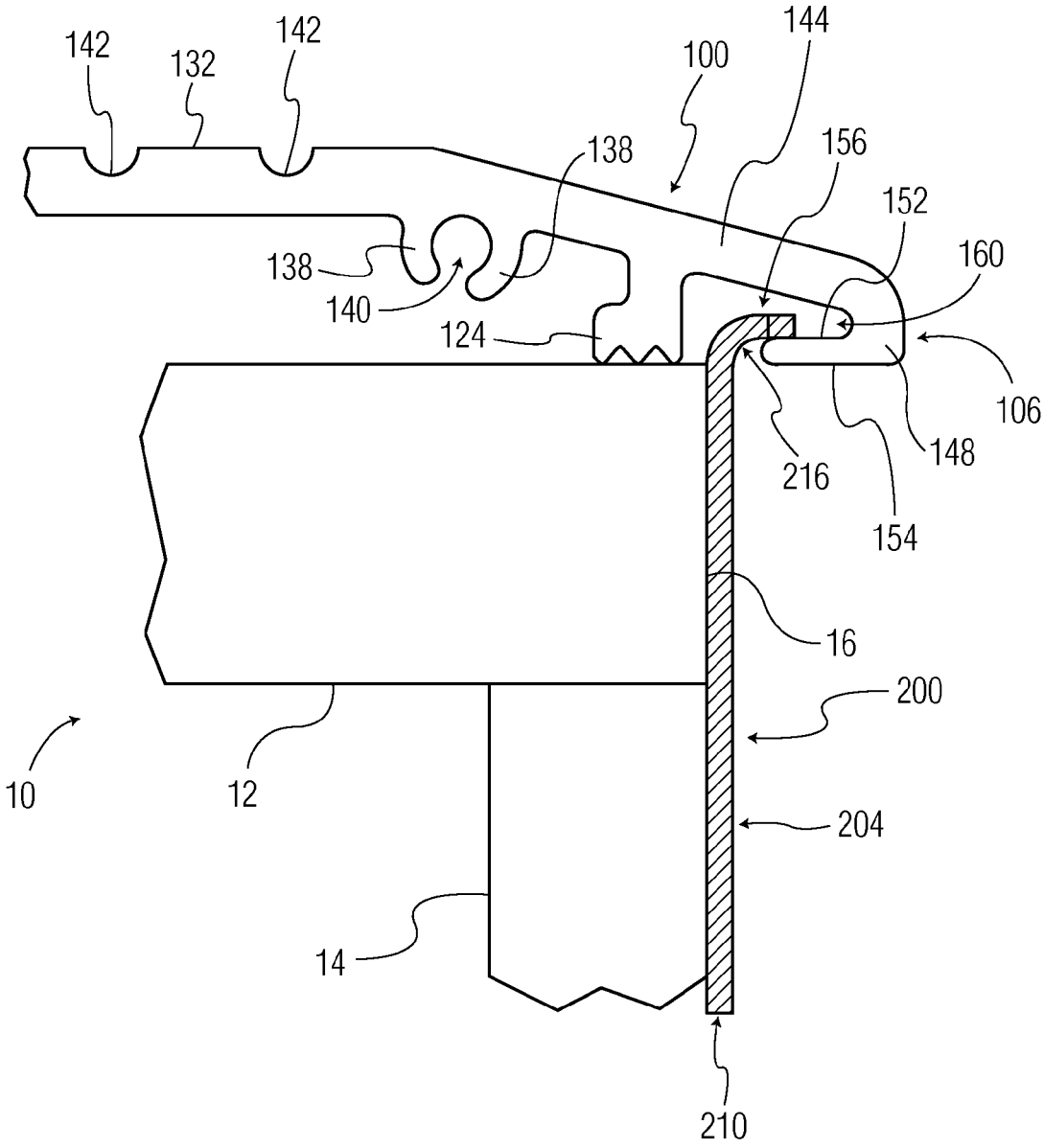
FIG. 1 is an orthogonal left side view of a portion of a threshold system according to an embodiment of the present invention.

Referring now to FIG. 1 in the drawings, a threshold system 10 according to the present invention is illustrated. Generally, the threshold system 10 comprises a threshold 100 and a flashing 200. The threshold 100 and flashing 200 are easily interlocked in a manner described below which allows optional use of the flashing 200 with the threshold 100. The threshold system 10 is well suited for installation near the juncture between a flooring component 12 and a wall component 14 located generally below a front 16 of the flooring component 12. The flooring component 12 may be constructed of a plywood or particleboard type material. Alternatively, the flooring component 12 may be constructed of wooden or metal studs that form a portion of a doorframe. Similarly, the wall component 14 may be constructed of wooden or metal studs, wooden wallboards, plastic, metal, or wooden exterior siding, or any other structure located generally below the front 16 of the flooring component 12. While the threshold system 10 is well suited for installation in a conventional doorway, the threshold system 10 is particularly well suited for installation into a modular door assembly (described above and not shown). The modular door assembly is easily installed into a doorframe of a conventional wooden framed building, a doorframe of a so-called metal building that is framed with metal components, or a doorframe of a so-called modular building. The threshold 100 may first be installed into the modular door assembly, the modular door assembly then installed into a doorway, and finally, the flashing 200 connected to the threshold 100 (as discussed infra).

Figure 2:
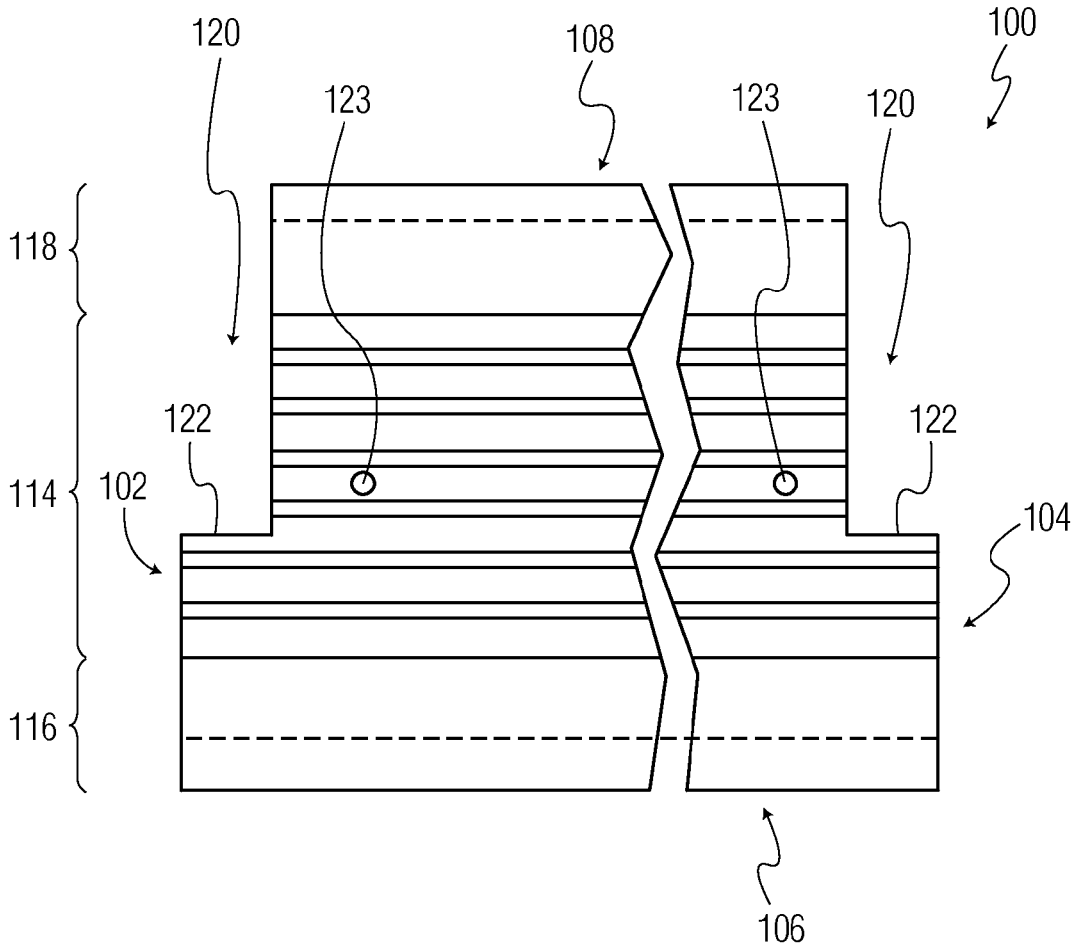
FIG. 2 is a foreshortened orthogonal top view of a threshold of the threshold system of FIG. 1.
Figure 3:
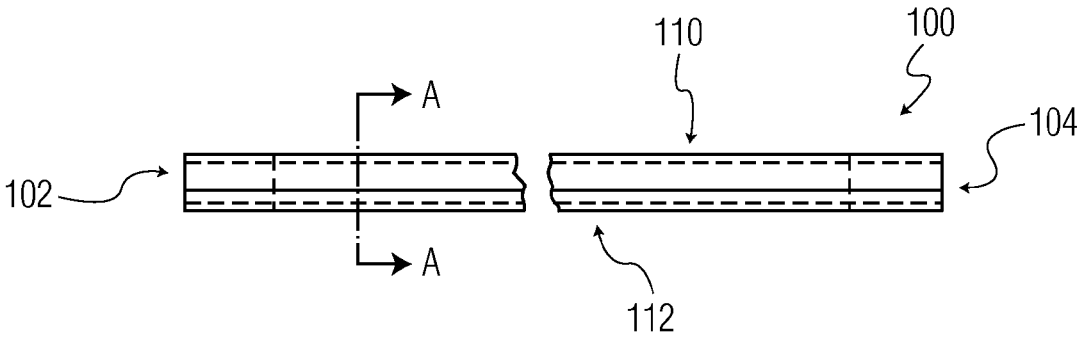
FIG. 3 is a foreshortened orthogonal front view of the threshold of FIG. 2.

Referring now to FIGS. 2 and 3 in the drawings, the threshold 100 according to the present invention is illustrated. Threshold 100 is a generally elongate member having a substantially consistent cross-sectional form. FIG. 2 illustrates an orthogonal top view of the threshold 100 in a longitudinally foreshortened manner. Similarly, FIG. 3 illustrates an orthogonal front view of the threshold 100 in a longitudinally foreshortened manner. For purposes of referring to directionality with respect to threshold 100, threshold 100 comprises a threshold left 102, a threshold right 104, a threshold front 106, a threshold rear 108, a threshold top 110, and a threshold bottom 112. As shown in FIG. 2, along the length of the depth of the threshold 100 (between the threshold front 106 and the threshold rear 108), the threshold 100 may be described as comprising a substantially planar midsection 114 bounded by a front incline 116 and a rear incline 118. However, alternative embodiments of the present invention may comprise a threshold 100 having any other suitable shape. Also as shown in FIG. 2, the threshold 100 comprises longitudinal recesses 120 located at the longitudinal ends of the threshold 100. Recesses 120 are substantially formed as an absence of material in the rear incline 118 and a similar absence of material in a portion of midsection 114. Recesses 120 serve to form midsection shoulders 122. Midsection shoulders 122 are generally suitable for abutment to a doorjamb portion (not shown) of a doorframe or to exterior faces (not shown) of a doorframe. Further, optional holes 123 may be used to allow fasteners therethrough for securing the threshold 100 to the flooring component 12.

Figure 4:
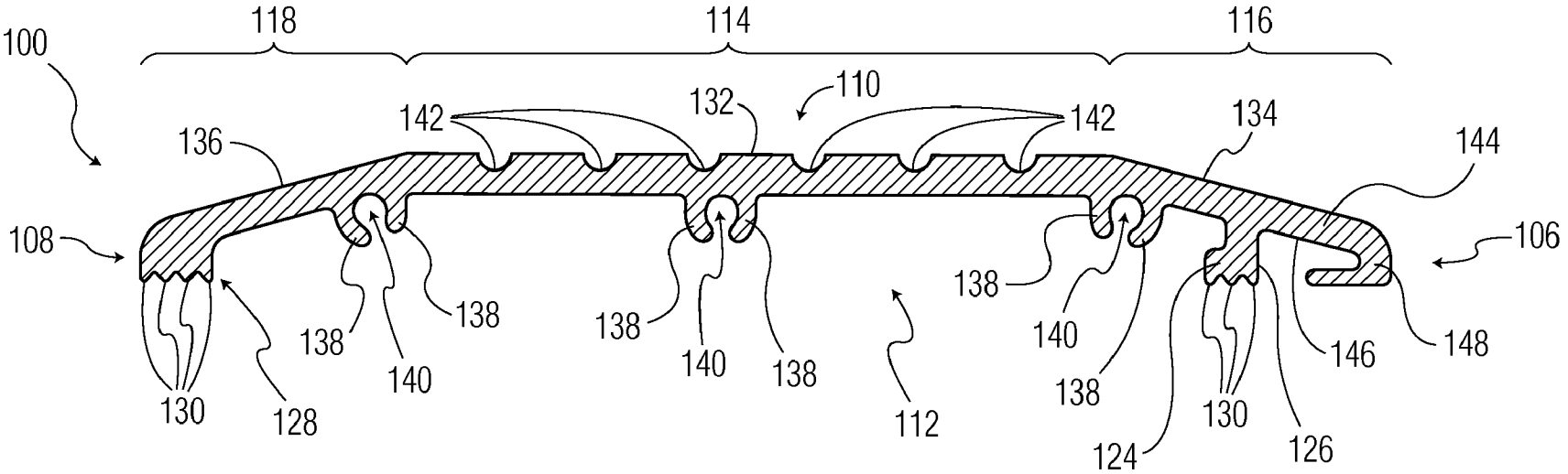
FIG. 4 is an orthogonal left side cross-sectional view taken at cutting line A-A of FIG. 3 of the threshold of FIG. 2.

Referring now to FIG. 4 in the drawings, a cross-sectional view of threshold 100 taken at cutting line at A-A of FIG. 3 is illustrated. Threshold 100 further comprises a front support 124 having a forward wall 126 and a rear support 128. Front support 124 and rear support 128 serve as primary interfaces between the threshold 100 and the flooring component 12 or surface beneath threshold 100 which vertically supports threshold 100. However, it will be appreciated that alternative embodiments of threshold 100 may include a different number of supports for supporting threshold 100. Each of front support 124 and rear support 128 comprise ridges 130 which enhance the ability of front support 124 and rear support 128 to securely engage the flooring component 12 or surface beneath the supports 124 and 128. However, it will be appreciated that alternative embodiments of threshold supports 124 and 128 may include differently shaped ridges 130, more or fewer ridges 130, or not ridges 130 at all. It will further be appreciated that alternative embodiments of supports 124 and 128 may provide that supports are substantially narrower than or more widely-based than supports 124 and 128 as illustrated.

The cross-sectional view of FIG. 4 clearly shows that a midsection surface 132 of midsection 114 is configured to lie parallel to the top of a flooring component 12 or the surface beneath threshold 100. It is further shown that front incline 116 provides a front inclined surface 134 that increases in height relative to the top of a flooring component 12 or the surface beneath the threshold 100 from the threshold front 106 toward the threshold rear 108. Similarly, it is shown that rear incline 118 provides a rear inclined surface 136 that increases in height relative to the top of a flooring component 12 or the surface beneath the threshold 100 from the threshold rear 108 toward the threshold front 106. Front incline 116 and rear incline 118 are configured to serve as gradual increases in height of the threshold 100 up to a maximum height (represented by midsection surface 132) relative to the top of a flooring component 12 or the surface beneath the threshold 100. This gradual increase in height serves to prevent inadvertent tripping of pedestrians traveling over the threshold 100 and to ease the rolling of wheeled carriers and the like across the threshold 100.

Threshold 100 further comprises ribs 138 protruding from the threshold bottom 112 and extending along the longitudinal length of the threshold 100. Three sets of two ribs 138 are configured to form three receptacles 140 for receiving fasteners (not shown) such as screws, bolts, rivets, and any other appropriate fasteners suitable for insertion into the space between the ribs 138 (receptacles 140) thereby securing the threshold left 102 and threshold right 104 to an adjacent doorframe or building structure. The longitudinally extending ribs 138 also serve to bolster resistance to longitudinal beam-type bending of the threshold 100 as force is applied to the threshold top 110.

Midsection 114 comprises longitudinally extending channels 142 which are generally formed as indentions which run along the length of midsection surface 132. Channels 142 are well suited for providing a somewhat corrugated or irregular feature to the midsection surface 132 to improve traction and to serve as reservoirs for dirt, water, and other particulate matter which may otherwise interfere with the interaction between the threshold 100 and a door or may otherwise present an unnecessary risk of slipping while walking atop midsection 114. However, it will be appreciated that in alternative embodiments of threshold 100, more or fewer channels 142 may be provided, channels 142 may be narrower, wider, deeper, or more shallow, channels 142 may be differently shaped, or channels 142 may not be provided on threshold 100 at all.

Figure 5:
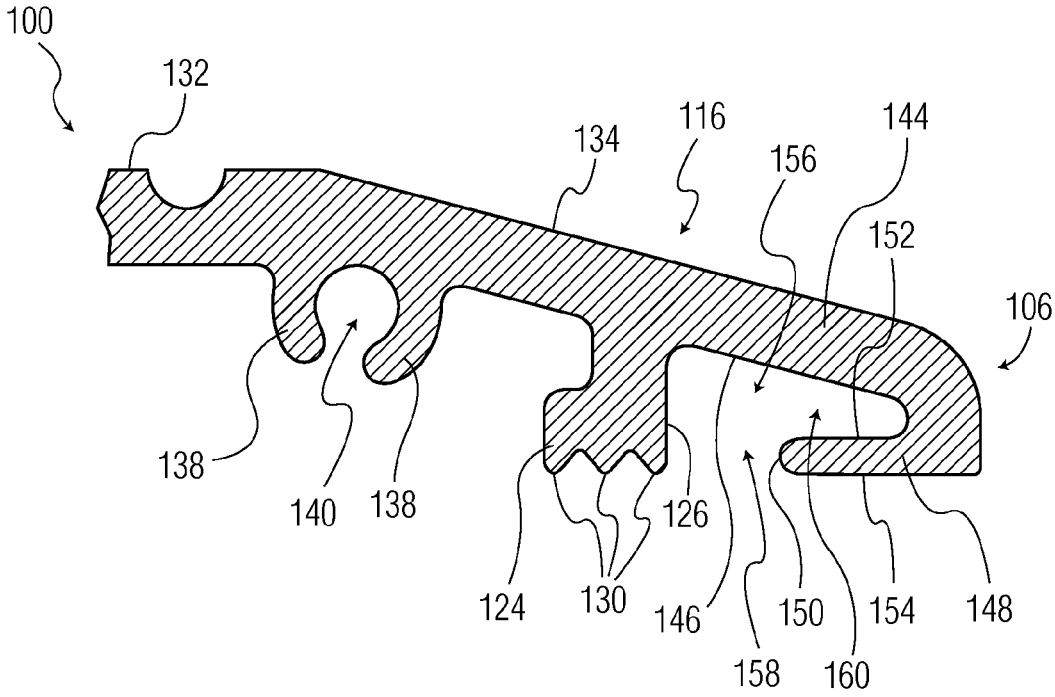
FIG. 5 is an orthogonal left side partial cross-sectional view taken at cutting line A-A of FIG. 3 of the threshold of FIG. 2.

Referring now to FIG. 5 in the drawings, an enlarged view of the front incline 116 of the threshold 100 is illustrated. Threshold 100 further comprises an arm 144, which forms a portion of the front incline 116, extending toward the threshold front 106 beyond support 124. Arm 144 comprises an underside 146 and a hook 148 which bends back toward the threshold rear 108. The hook 148 comprises a hook tip 150 which generally faces forward wall 126, a hook upper side 152, and a hook lower side 154. While the hook tip 150 extends toward forward wall 126, the hook tip 150 does not extend fully to the forward wall 126, but instead, terminates a distance away from forward wall 126. A flashing receiving space 156 is generally bounded by forward wall 126, underside 146 of arm 144, and hook upper side 152. The space between hook tip 150 and forward wall 126 serves as a passage 158 for allowing ingress and egress of a portion of the flashing 200 (discussed infra) with respect to the flashing receiving space 156. Further, a frontal pocket 160 is generally defined as the space within flashing receiving space 156 between hook upper side 152 and the underside 146 of arm 144.

Threshold 100 is constructed of a substantially rigid, nonporous wear and corrosion resistant material such as aluminum; however, it will be appreciated that threshold 100 may be constructed of steel, plastic, or any other suitable material. Further, threshold 100 is formed through an extrusion process and subsequent machining; however, it will be appreciated that threshold 100 may alternatively be formed through any other suitable manufacturing process.

Figure 6:
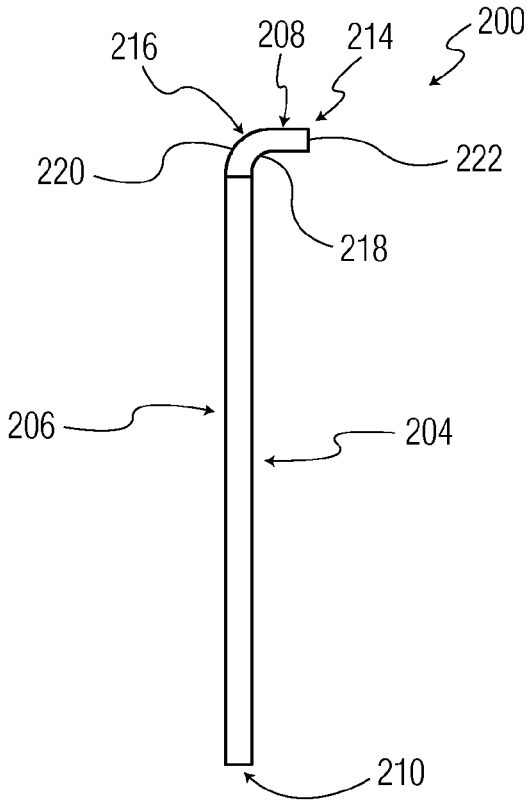
FIG. 6 is an orthogonal left side view of a flashing of the threshold system of FIG. 1.

Referring now to FIG. 6 in the drawings, flashing 200 is a generally plate-like elongate member having a flashing left 202, flashing front 204, flashing rear 206, flashing top 208, flashing bottom 210, and flashing right 212. Flashing 200 also comprises a flange 214 generally protruding from the flashing top 208 and extending toward the flashing front 204. Flange 214 is illustrated as comprising a bend 216. Bend 216 comprises an inner bend surface 218 and an outer bend surface 220. The bend 216 is generally formed as a curved section having about a 90 degree angle; however, it will be appreciated that in alternative embodiments, the bend 216 may be formed at angles greater or less than 90 degrees by a substantial margin. Finally, a flange tip 222 represents the portion of the flange that is located furthest toward the flashing front 204. The flange 214 may be formed simply by a bending process. The flashing 200 is longitudinally longer than the threshold 100, but may alternatively be the same length as the threshold 100 or shorter than the threshold 100, depending on the circumstances of a particular application or building structure.

Figure 7:
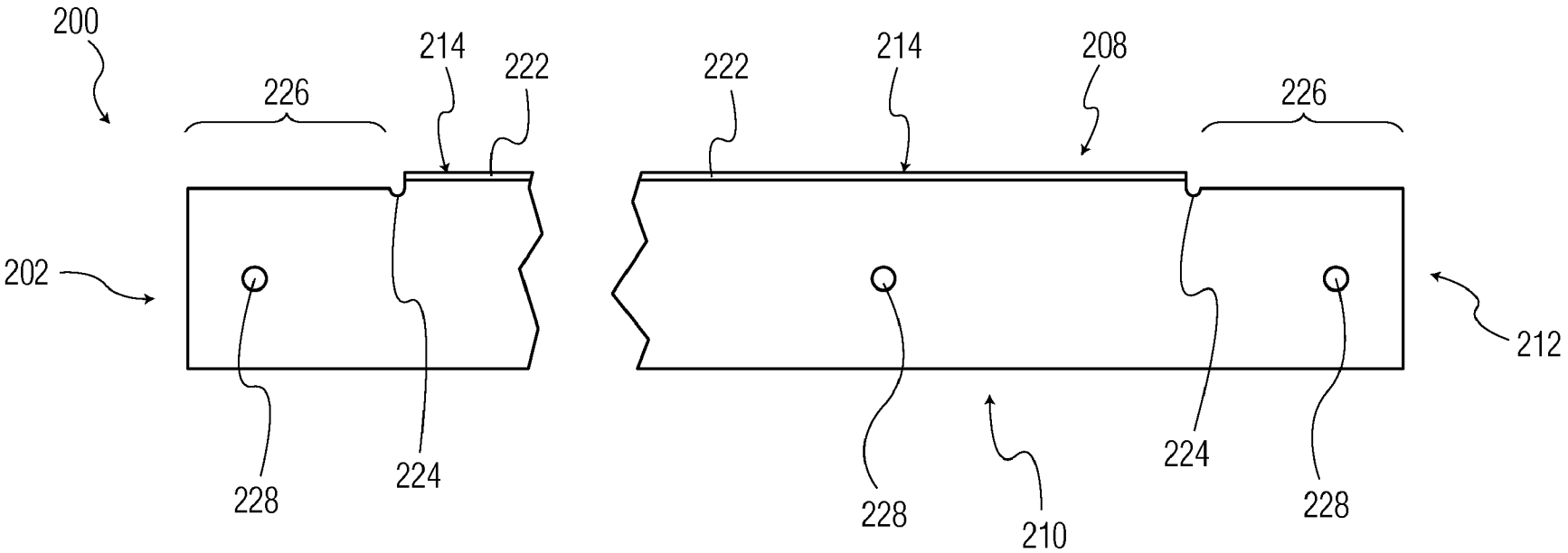
FIG. 7 is a foreshortened orthogonal top view of the flashing of the threshold system of FIG. 6.
Figure 8:
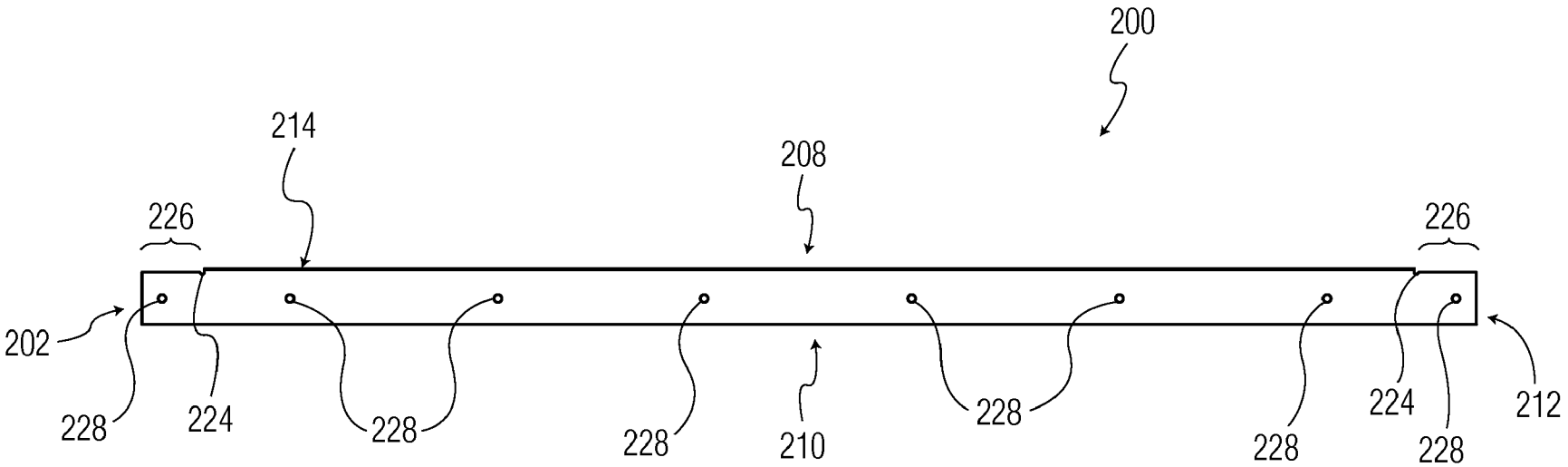
FIG. 8 is an orthogonal top view of the flashing of the threshold system of FIG. 6.

Referring now to FIGS. 7 and 8 in the drawings, orthogonal front views of the flashing 200 are illustrate where FIG. 7 shows flashing 200 in a longitudinally foreshortened manner while FIG. 8 show the entire longitudinal length of flashing 200. Flashing 200 further comprises notches 224 located between the ends of the flange 214 and reduced height portions 226. Flashing 200 also comprises mounting holes 228 formed from the threshold front 106 to the threshold rear 108.

Flashing 200 is constructed of a substantially rigid, nonporous wear and corrosion resistant material such as aluminum; however, it will be appreciated that flashing 200 may be constructed of steel, plastic, or any other suitable material. Further, flashing 200 is formed generally by cutting and bending plate-like stock of material; however, it will be appreciated that flashing 200 may alternatively be formed through any other suitable manufacturing process.

Figure 9:
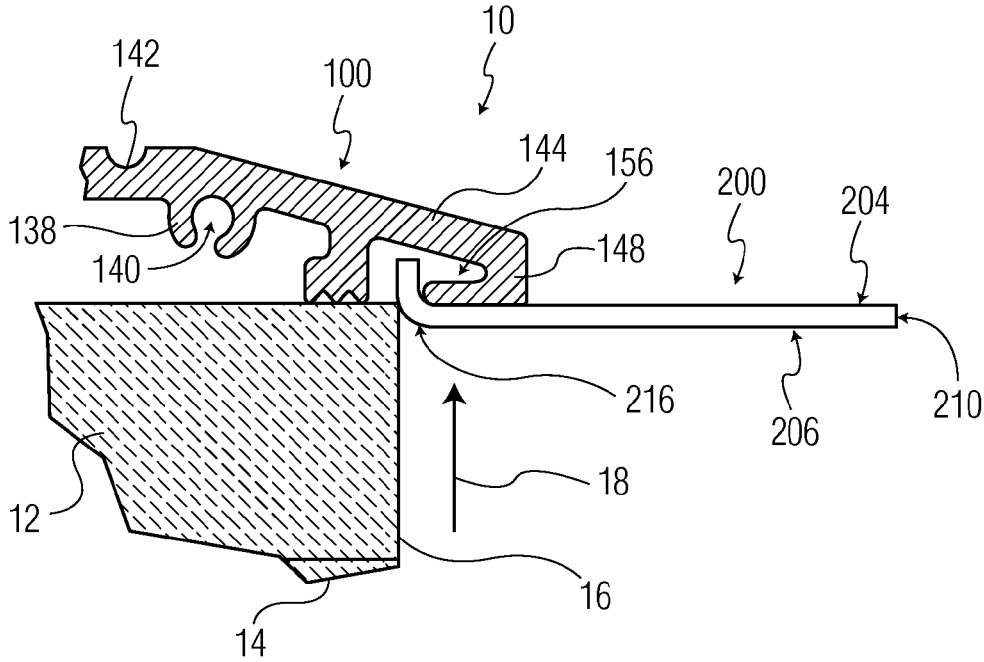
FIG. 9 is an orthogonal left side view of a portion of the threshold system of FIG. 1 where the threshold system is configured in an initial insertion configuration.
Figure 10:
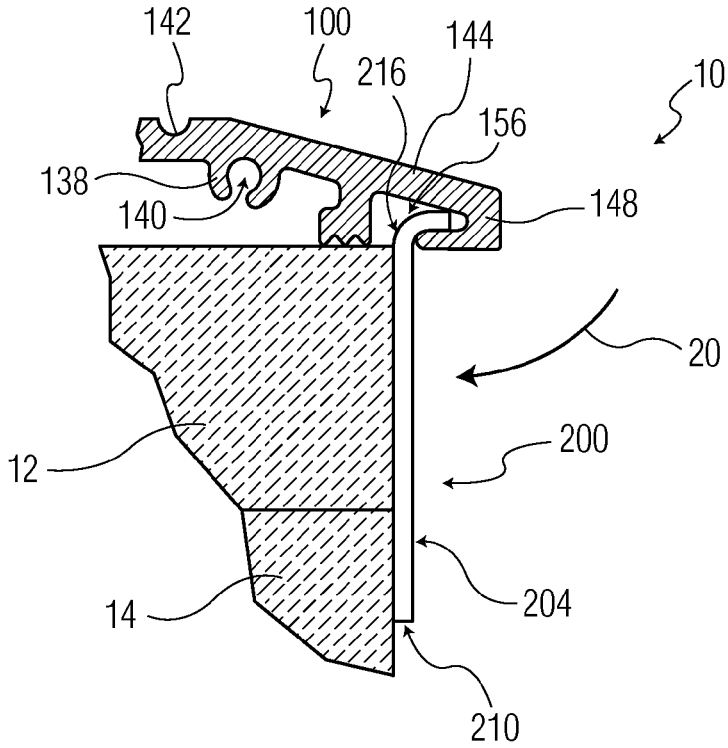
FIG. 10 is an orthogonal left side view of a portion of the threshold system of FIG. 1 where the threshold system is configured in a final inserted configuration.

Referring now to FIGS. 9 and 10 in the drawings, orthogonal cross-sectional side views (viewing toward the threshold left 102 and flashing left 202) of the threshold system 10 illustrate the threshold system 10 in an initial insertion configuration and a final installed configuration, respectively. In operation, the threshold system is first secured relative to the flooring component 12 by inserting fasteners associated with a door frame into recesses 140, inserting fasteners through optional holes 123 and into the flooring component 12, or both. As seen most clearly in FIGS. 1, 9, and 10, the threshold 100 is aligned with respect to the front 16 of the flooring component 12 such that the hook tip 150 is displaced a sufficient distance away from the front 16 so as to allow insertion of flange tip 222 into flashing receiving space 156 through passage 158. Next, as shown in FIG. 9, flashing 200 is oriented such that flashing front 204 faces threshold bottom 112, inner bend surface 218 is located between front 16 and hook tip 150, and flashing bottom 210 faces the same direction as threshold front 106. Next, and still referring to FIG. 9, flashing 200 is vertically displaced in the direction of vertical arrow 18 to bring flashing front 204 substantially adjacent to hook lower side 154. In this position, the initial insertion configuration, flange 214 (at least flange tip 222) is substantially inserted into flashing receiving space 156. Next, and now referring to FIG. 10, the flashing 200 is rotated in the direction of curved arrow 20, the rotation being allowed by a hinge-like connection between the threshold 100 and the flashing 200, such that the flashing rear 206 lies substantially adjacent to the front 16 and the wall component 14, all while keeping the flange tip 222 within the flashing receiving space 156. In this embodiment of threshold system 10, flange tip now lies further away from front 16 than hook tip 150, preventing downward vertical displacement of flashing 200 with respect to threshold 100. In this position, the final installed configuration, fasteners (not shown) may be inserted through mounting holes 228 to secure the flashing 200 to the flooring component 12 and/or to the wall component, depending on the structure of the particular building.

Upon installation of the threshold system 10 to a doorway, several advantages may be realized. For example, by securing the flashing 200 to a flooring component 12 and/or a wall component 14, the threshold system 10 will reduce penetration into the building and/or to the flooring component 12 (or other support surface) by water, insects, air, particulate matter, and other undesirable elements. This sealing advantage is obtained without the need to perform any caulking of the flashing 200, although a user may optionally caulk or otherwise apply a sealant to the flashing 200 for enhanced sealing performance. Another advantage of installing the threshold system 10 to a doorway is that the flashing 200 will conceal from view any ragged saw cuts, worn edges, non-linear surfaces, or otherwise unsightly building materials used to form the doorway.

Further, installation of the threshold system 10 provides needed structural support in the case where a doorway has previously been damaged, rotted, or otherwise deteriorated. For example, where a flooring component 12 and/or a wall component 14 are already weak, the threshold system 10, and the flashing 200 in particular, allow a user to bolster the strength of a threshold by affixing the flashing 200 to materials or areas of structure that are not damaged and are suitable for supporting the interconnected threshold 100. Depending on the circumstances of the particular doorway condition, this allows a user to install the threshold system 10 to a damaged doorway without first needing to replace all the damaged support materials of the damaged doorway. In the case where an outermost edge of the flooring component is weak, misshapen, or otherwise incapable of sufficiently supporting the threshold 100 in a substantially fixed position, the interconnected flashing is useful in that it provides vertical support to the threshold. Particularly, if a threshold 100 tends to displace downward, the flashing 200 aids in vertically supporting the threshold 100 by interaction between the flange 214 and the underside 146 of arm 144 such that flange 214 provides an upward reactionary force to underside 146, diminishing or impeding longitudinal beam-type bending of threshold 100. Further, by connecting a flashing 200 to a threshold 100, undesirable torsional bending (twisting) of the threshold 100 may be diminished or impeded. This undesirable twisting may be onset by unsuitable support materials as describe above in combination with uneven loading of forces to the threshold top 110. The twisting may be diminished by the interaction between the flange 214 and each of the underside 146 of arm 144 and hook upper side 152. The flange 214 may provide both an upward reactionary force to underside 146 and a downward reactionary force to the hook upper side 152.

In some particular installation scenarios, it may be desirable to use the threshold system 10 without installing the flashing 200. This optional use of the flashing 200 allow the same threshold 100 design to be used with many more types of doorways which would benefit from the above described features of the threshold 100 but have no application for the optionally associated flashing 200. This allows a manufacturer of modular door assemblies to preinstall the threshold 100 knowing that even if the flashing 200 is not needed in a particular application of the modular door assembly, installation of the modular door assembly can proceed unimpeded and without the additional cost of having supplied an unnecessary flashing 200. Further, since the flashing 200 is installed after installation of threshold 100 and may be transported separately from the modular door assembly, the flashing 200 may be easily protected throughout shipping and at all times prior to installation.

Further, as noted above, holes 123 in threshold 100 are optional. When the particular circumstances of an installation of a threshold system 10 allow, improved sealing performance is obtained by a lack of holes 123. If threshold 100 is installed without holes 123, there exists no passage (or other support surface) to allow undesirable introduction of air, water, dirt, insects, particulate matter, or other harmful substances to reach flooring component 12 (or other support surface).

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A threshold system, comprising:

a threshold;

a front support carried by the threshold;

an arm carried by the threshold;

a portion of a threshold front incline formed by the front support and the arm, the threshold front incline extending toward a threshold front;

an underside and a hook forming the arm, the hook bending downward from a distal end of the underside and back toward a threshold rear, the hook having a flat upper side and a bend that opens rearwardly and toward the front support, the underside and the hook defining a flashing receiving space within the arm;

a flashing removably connected to the threshold, the flashing having a flange with a flange tip, the flange and flange tip extending toward the threshold front and positioned within the flashing receiving space;

a frontal pocket within the arm, the frontal pocket being defined by a space within the flashing receiving space between the hook upper side, the underside of the arm, the hook bend, and the flange tip.

2. The threshold system according to claim 1, wherein the flashing vertically supports the threshold.

* * * * *